US012729488B2

(12) United States Patent
Zhang

(10) Patent No.: US 12,729,488 B2
(45) Date of Patent: Sep. 8, 2026

(54) MAGNETIC TRACK MODULE, COMPOSITE PERMANENT-MAGNETIC TRACK AND INSTALLATION METHOD THEREOF

(71) Applicant: JIANGXI UNIVERSITY OF SCIENCE AND TECHNOLOGY, Jiangxi (CN)

(72) Inventor: Zeyi Zhang, Jiangxi (CN)

(73) Assignee: JIANGXI UNIVERSITY OF SCIENCE AND TECHNOLOGY, Jiangxi (CN)

( * ) Notice: Subject to any disclaimer, the term of this patent is extended or adjusted under 35 U.S.C. 154(b) by 447 days.

(21) Appl. No.: 18/494,493

(22) Filed: Oct. 25, 2023

(65) Prior Publication Data

US 2024/0133126 A1 Apr. 25, 2024
US 2024/0229367 A9 Jul. 11, 2024

(30) Foreign Application Priority Data

Oct. 25, 2022 (CN) ..... 202211311581.1

(51) Int. Cl.
*E01B 25/30* (2006.01)

(52) U.S. Cl.
CPC ..... *E01B 25/30* (2013.01)

(58) Field of Classification Search
CPC ..... E01B 25/30
See application file for complete search history.

(56) References Cited

FOREIGN PATENT DOCUMENTS

| | | | | |
|---|---|---|---|---|
| CN | 101003961 A | | 7/2007 | |
| CN | 201251977 Y | | 6/2009 | |
| CN | 102376413 A | | 3/2012 | |
| CN | 205645427 U | | 10/2016 | |
| CN | 108114808 A | * | 6/2018 | ..... B03C 1/02 |
| KR | 1020100070611 A | | 6/2010 | |

* cited by examiner

*Primary Examiner* — Robert J McCarry, Jr.
(74) *Attorney, Agent, or Firm* — Calfee, Halter & Griswold LLP

(57) ABSTRACT

The present disclosure relates to the technical field of the permanent-magnetic track, and discloses a magnetic track module, a composite permanent-magnetic track and an installation method thereof. The magnetic track module comprises: at least two layers of magnetic units that are staggered in the first direction and stacked in the second direction with the same magnetization direction, wherein each magnetic unit is formed by a plurality of closely-arranged permanent magnets; and a bottom ferromagnetic plate that covers the lower surface of the bottom magnetic unit, with an attractive magnetic force existing between the bottom ferromagnetic plate and the adjacent magnetic unit.

7 Claims, 2 Drawing Sheets

MAGNETIC TRACK MODULE, COMPOSITE PERMANENT-MAGNETIC TRACK AND INSTALLATION METHOD THEREOF

CROSS-REFERENCE TO RELATED APPLICATION

This application claims the benefit of Chinese Patent Application No. 202211311581.1 filed on Oct. 25, 2023, which is hereby incorporated herein by reference in its entirety.

FIELD

The present disclosure relates to the technical field of the permanent-magnetic track, in particular to a magnetic track module, a composite permanent-magnetic track and an installation method thereof.

BACKGROUND

Most permanent-magnetic tracks employ a single-layer structure in which permanent magnets are longitudinally sequentially arranged with the same magnetization direction. However, there is a large repulsive magnetic force between two adjacent permanent magnets. The repulsive force undermines the close arrangement of the permanent magnets, which further amplifies the longitudinal fluctuation of the magnetic field intensity above the permanent-magnetic track, threatens the stability and safety of the permanent-magnetic track, and seriously affecting the running smoothness of the maglev train.

SUMMARY

The object of the present disclosure is to provide a magnetic track module, a composite permanent-magnetic track and a preparation method thereof. In the magnetic track module, the static frictional force between two adjacent magnetic units and between the bottom ferromagnetic plate and the adjacent magnetic unit is utilized to balance out all or part of the repulsive magnetic force between two adjacent permanent magnets in the same magnetic unit, which further reduces the gap between two adjacent permanent magnets in the same magnetic unit, enhances the stability and safety of the magnetic track module, and optimizes the longitudinal uniformity of the magnetic field intensity above the magnetic track module.

To attain the object described above, in the first aspect, the present disclosure provides a magnetic track module, which comprises:

at least two layers of magnetic units that are staggered in the first direction and stacked in the second direction with the same magnetization direction, wherein each magnetic unit is formed by a plurality of permanent magnets that share the same magnetization direction and are arranged closely in the first direction, and the magnetization direction is along the second direction;

a bottom ferromagnetic plate that covers the lower surface of the bottom magnetic unit, with attractive magnetic force existing between the bottom ferromagnetic plate and the adjacent magnetic unit;

under the attractive magnetic force between two adjacent magnetic units and between the bottom ferromagnetic plate and the adjacent magnetic unit, the static frictional force generated between two adjacent magnetic units and between the bottom ferromagnetic plate and the adjacent magnetic unit can balance out all or part of the repulsive magnetic force between two adjacent permanent magnets in the same magnetic unit;

and a protective sleeve made of a non-ferromagnetic material, and the protective sleeve has an accommodating space fitting the magnetic units and the bottom ferromagnetic plate and two openings at the two ends in connection with the accommodating space; the magnetic units and the bottom ferromagnetic plate are partially wrapped in the protective sleeve, so that the magnetic units maintain the staggered and stacked layout and form two connecting structures at the two ends of the protective sleeve.

Based on the staggered layout between two adjacent magnetic units, the static frictional force between two adjacent permanent magnets in different magnetic units is increased with the help of the attractive magnetic force between them; thus, all or part of the repulsive magnetic force between two adjacent permanent magnets in the same magnetic unit can be balanced out by the static frictional force, which further reduces the gap between two adjacent permanent magnets in the same magnetic unit and enhances the stability and safety of the magnetic track module. Besides, by utilizing the complementary relationship of magnetic fields between two adjacent magnetic units, the longitudinal distribution of magnetic field intensity above them will be more uniform.

Furthermore, the staggered layout between two adjacent magnetic units refers to that the gap between two adjacent permanent magnets in one magnetic unit is located at the middle of the permanent magnet in the adjacent magnetic unit.

Furthermore, two adjacent magnetic units are bonded to each other and the bottom ferromagnetic plate and the adjacent magnetic unit are bonded to each other by means of adhesive.

Furthermore, the non-ferromagnetic material comprises at least one of plastic, carbon fiber, aluminum alloy, and stainless steel.

Furthermore, the two connecting structures comprise a connecting cavity and a connecting protrusion that fit in with each other and are formed at the two ends of the protective sleeve respectively; the connecting cavity is formed by the staggered displacement between the two layers of magnetic units and the wall of the protective sleeve; and the connecting protrusion is formed by the protruding part of the permanent magnet out of the protective sleeve.

Furthermore, the bottom ferromagnetic plate is made of a soft-magnetic material with a high magnetic permeability.

In the second aspect, the present disclosure provides a composite permanent-magnetic track, which comprises a plurality of magnetic track modules described above, wherein the magnetic track modules are connected to each other via the connecting structures.

The composite permanent-magnetic track composed of the above magnetic track modules has a more uniform longitudinal distribution of magnetic field intensity above it, and its stability and safety are significantly improved.

In a third aspect, the present disclosure provides a method for installing the composite permanent-magnetic track, which comprises the following steps: assembling a plurality of magnetic track modules via the connecting structures.

The composite permanent-magnetic track obtained with the installation method has a more uniform longitudinal distribution of magnetic field intensity above it, and its stability and safety are significantly improved.

Furthermore, the connecting protrusion of one magnetic track module is connected to the connecting cavity of another magnetic track module, forming a composite permanent-magnetic track on which the protective sleeves are aligned to each other at the connection.

Other features and advantages of the present disclosure will be further detailed in the following embodiments.

REFERENCE NUMBERS

10—magnetic unit; 11—permanent magnet; 20—bottom ferromagnetic plate; 30—protective sleeve; 31—connecting cavity; 32—connecting protrusion; 33—opening.

Embodiments

Hereunder some embodiments of the present disclosure will be described in detail. It should be understood that the embodiments described herein are only provided to describe and explain the present disclosure, but are not intended to constitute any limitation to the present disclosure.

In the present disclosure, unless otherwise specified, the terms that denote orientations are used as follows; for example, "top" and "bottom" usually refer to the orientations in assembly and operation states. "Inside" and "outside" usually refers to inside and outside with respect to the outlines of the components.

It should be noted that the terms "first" and "second", etc. in the Description, Claims, and above-mentioned accompanying drawings of the present disclosure are intended to differentiate similar objects, and may not be necessarily used to describe a specific order or precedence. It should be understood that the terms used in such a way are interchangeable as appropriate, to facilitate the description of the embodiments. Moreover, the terms "comprise" and "have" and any variant of them are intended to encompass non-exclusive inclusions, such as any processes, methods, systems, products or apparatuses that include a series of steps or units, not limited to the steps or units that are clearly listed; instead, such steps or units may include other steps or units that are not listed clearly or not intrinsic to those processes, methods, products, or apparatuses.

Figure 1:
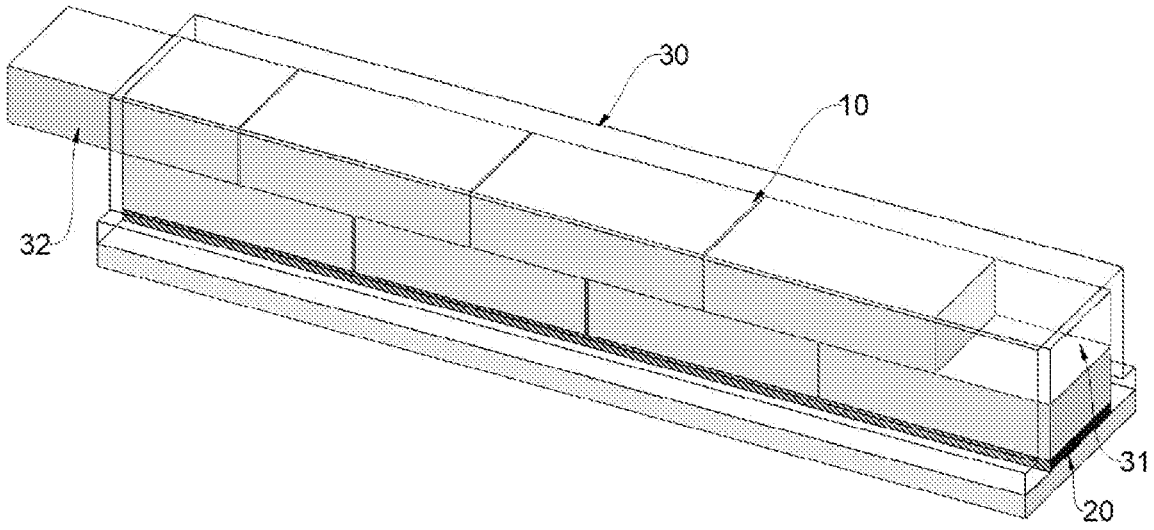
FIG. 1 is a schematic structural diagram of an embodiment of the magnetic track module.
Figure 2:
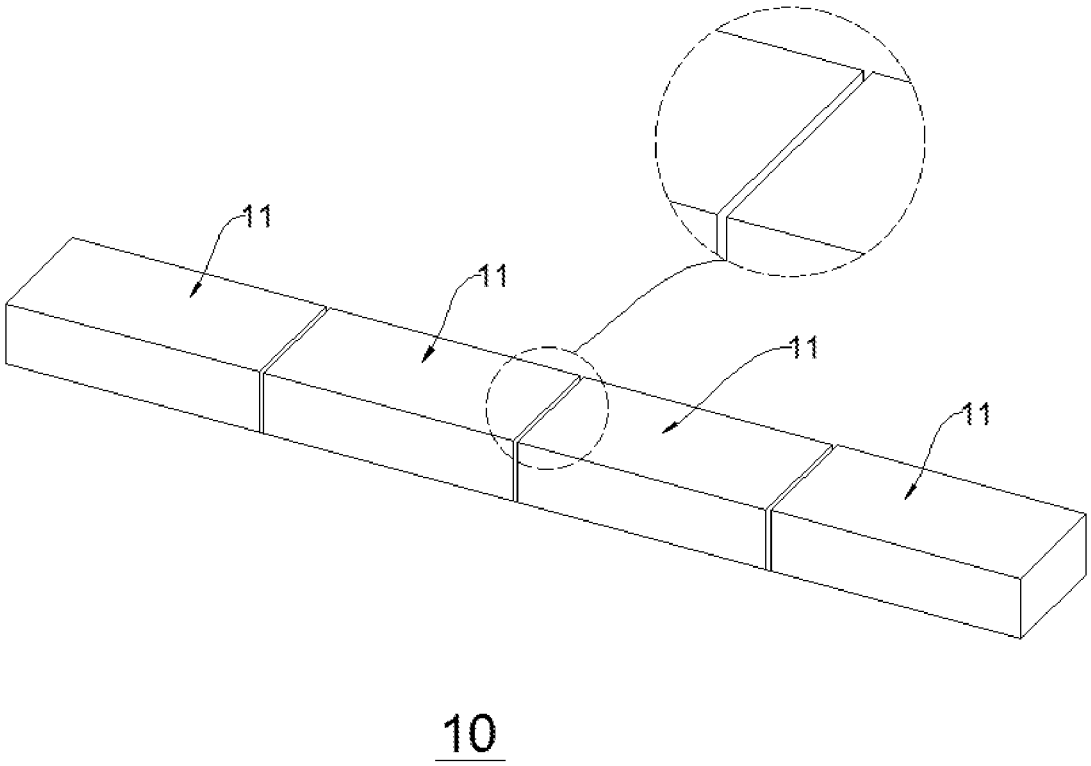
FIG. 2 is a schematic structural diagram of an embodiment of the magnetic unit.
Figure 3:
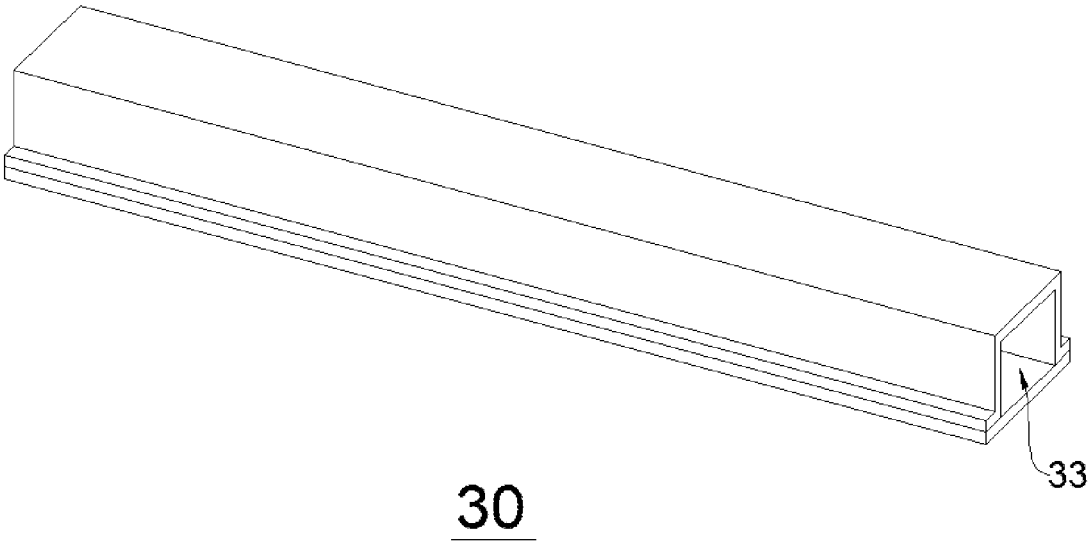
FIG. 3 is a schematic structural diagram of an embodiment of the protective sleeve.

In the first aspect, the present disclosure provides a magnetic track module. As shown in FIGS. 1-3, the magnetic track module comprises two layers of magnetic units 10, a bottom ferromagnetic plate 20. Two magnetic units 10 are staggered in the first direction and stacked in the second direction with the same magnetization direction (for example, the north pole is at the top surface and the south pole is at the bottom surface). The magnetic unit 10 is formed by a plurality of permanent magnets 11 that share the same magnetization direction and are arranged closely in the first direction. The magnetization direction is along the second direction. The bottom ferromagnetic plate 20 covers the lower surface of the bottom magnetic unit 10, with attractive magnetic force existing between the bottom ferromagnetic plate and the adjacent magnetic unit 10. Under the attractive magnetic force between two adjacent magnetic units 10 and between the bottom ferromagnetic plate 20 and the adjacent magnetic unit 10, the static frictional forces are generated between two adjacent magnetic units 10 and between the bottom ferromagnetic plate 20 and the adjacent magnetic unit 10 and can balance out all or part of the repulsive magnetic force between two adjacent permanent magnets 11 in the same magnetic unit 10.

It should be explained that the aforesaid "first direction" refers to the longitudinal direction of the magnetic unit 10, and the "second direction" refers to the stacking direction of the magnetic units 10.

In a preferred embodiment, the bottom ferromagnetic plate 20 is made of a soft-magnetic material with a high magnetic permeability. Specifically, soft-magnetic materials with a high magnetic permeability include pure iron, low carbon steel, silicon steel, iron-nickel alloys, and iron-based or cobalt-based amorphous alloys, etc. On one hand, the bottom ferromagnetic plate 20 can be used as the adsorption object for the magnetic units 10 to increase the static frictional force between the bottom ferromagnetic plate 20 and the adjacent magnetic unit 10, so as to balance out all or part of the magnetic repulsive force between two adjacent permanent magnets 11 in the same magnetic unit 10. On the other hand, the bottom ferromagnetic plate 20 can shield and reduce the radiation of the magnetic field of the magnetic units 10 beyond it.

Based on the staggered layout between two adjacent magnetic units, the static frictional force between two adjacent permanent magnets 11 in different magnetic units is increased with the help of the attractive magnetic force between them; thus, all or part of the repulsive magnetic force between two adjacent permanent magnets 11 in the same magnetic unit 10 can be balanced out by the static frictional force, which further reduces the gap between two adjacent permanent magnets 11 in the same magnetic unit 10 and enhances the stability and safety of the magnetic track module. Besides, by utilizing the complementary relationship of magnetic fields between two adjacent magnetic units, the longitudinal distribution of magnetic field intensity above them will be more uniform.

In a preferred embodiment, the staggered layout between two adjacent magnetic units 10 refers to that the gap between two adjacent permanent magnets 11 in one magnetic unit 10 is located at the middle of the permanent magnet 11 in the adjacent magnetic unit (i.e., at half length of the magnet). Of course, alternatively the gap may be located at one-third length, a quarter length, etc. of the permanent magnet 11 in the adjacent magnetic unit 10.

As shown in FIG. 2, a plurality of permanent magnets 11 are closely arranged in the first direction to form a magnetic unit 10, and there is a gap between two adjacent permanent magnets 11. And, the gap is caused by the repulsive magnetic force between two adjacent permanent magnets 11.

In the current metallurgy engineering, the permanent magnets 11 are produced by powder metallurgy process. Thus, it is impossible to produce a permanent magnet 11 in a length of several meters or even more than ten meters at present. This aspect also formulates one significance of the present disclosure, i.e., the composite permanent-magnetic track is modularized so that it can be assembled on the construction site. In the technical scheme of the present disclosure, the length of the permanent magnet 11 is preferable to be 0.1-0.2 m.

In order to further increase the static frictional force between two adjacent magnetic units 10 and between the bottom ferromagnetic plate 20 and the adjacent magnetic unit 10, two adjacent magnetic units 10 are bonded to each other and the bottom ferromagnetic plate 20 and the adjacent magnetic unit 10 are bonded to each other by means of adhesive (e.g., glue or double-sided tape). It should be noted that the adhesive is mainly used to increase the static frictional coefficient between two adjacent magnetic units 10 and between the bottom ferromagnetic plate 20 and the adjacent magnetic unit 10.

In order to realize the bending or warping of the composite permanent-magnetic track, the bottom ferromagnetic plate 20 may be pre-stressed and the geometric parameters of the permanent magnets 11 may be accordingly adjusted.

As shown in FIGS. 1 and 3, the magnetic track module further comprises a protective sleeve 30 made of a non-ferromagnetic material. The non-ferromagnetic material may be any one or more of plastic, carbon fiber, aluminum alloy and stainless steel. An accommodating space fitting the magnetic units 10 and the bottom ferromagnetic plate 20 is formed inside the protective sleeve 30, and two openings 33 in connection with the accommodating space are formed at the two ends of the protective sleeve 30. The magnetic units 10 and the bottom ferromagnetic plate 20 are partially wrapped in the protective sleeve 30, so that the magnetic units 10 maintain the staggered and stacked layout and form two connecting structures at the two ends of the protective sleeve 30.

Furthermore, the two connecting structures of one magnetic track module include connecting cavity 31 and a connecting protrusion 32 that fit in with each other and are formed at the two ends of the protective sleeve 30 respectively. As shown in FIG. 1, the connecting cavity 31 is formed by the staggered displacement between the two magnetic units 10 and the wall of the protective sleeve 30; and the connecting protrusion 32 is formed by the protruding part of the permanent magnet 11 out of the protective sleeve 30.

In the production, the magnetic track module is prepared a magnetic-material processing factory and is further used to construct a continuous composite permanent-magnetic track (e.g., each of the upper and lower magnetic units 10 is composed of ten permanent magnets 11). During the construction of the composite permanent-magnetic track, the magnetic track modules are connected and fixed in an end-to-end manner based on the arrangement of the connecting cavity 31 and the connecting protrusion 32.

In the second aspect, the present disclosure provides a composite permanent-magnetic track, which comprises a plurality of magnetic track modules. The magnetic track modules are connected to each other via the connecting structures. The composite permanent-magnetic track composed of the above magnetic track modules has a more uniform longitudinal distribution of magnetic field intensity above it, and its stability and safety are significantly improved.

In a third aspect, the present disclosure provides a method for installing the composite permanent-magnetic track, which comprises: assembling a plurality of magnetic track modules via the connecting structures. The composite permanent-magnetic track obtained with the installation method has a more longitudinal uniform distribution of magnetic field intensity above it, and its stability and safety are significantly improved.

Furthermore, the connecting protrusion 32 of one magnetic track module is connected to the connecting cavity 31 of another magnetic track module, forming a composite permanent-magnetic track on which the protective sleeves 30 are aligned to each other at the connection.

While some preferred embodiments of the present disclosure are described in detail above, the present disclosure is not limited to the details in those embodiments. Those skilled in the art can make modifications and variations to the technical solution of the present disclosure, without departing from the spirit of the present disclosure. However, all these modifications and variations shall be deemed as falling into the protected scope of the present disclosure.

In addition, it should be noted that the specific technical features described in the above embodiments may be combined in any appropriate form, provided that there is no conflict among them. To avoid unnecessary repetition, various possible combinations are not described specifically in the present disclosure.

Moreover, different embodiments of the present disclosure may also be combined freely as required, as long as the combinations don't deviate from the ideal of the present disclosure. However, such combinations shall also be deemed as being disclosed in the present disclosure.

The invention claimed is:

1. A magnetic track module, comprising:

at least two layers of magnetic units that are staggered in a first direction and stacked in a second direction with the same magnetization direction, wherein each magnetic unit is formed by a plurality of permanent magnets that share the same magnetization direction and are arranged closely in the first direction, and the magnetization direction is along the second direction;

a bottom ferromagnetic plate that covers a lower surface of the bottom magnetic unit, with an attractive magnetic force between the bottom ferromagnetic plate and the adjacent magnetic unit;

under the attractive magnetic forces between two adjacent magnetic units and between the bottom ferromagnetic plate and the adjacent magnetic unit, static frictional forces are generated between two adjacent magnetic units and between the bottom ferromagnetic plate and the adjacent magnetic unit and are able to balance out all or part of the repulsive magnetic forces between two adjacent permanent magnets in the same magnetic unit; and a protective sleeve made of a non-ferromagnetic material, and the protective sleeve has an accommodating space fitting the magnetic units and the bottom ferromagnetic plate and two openings at the two ends in connection with the accommodating space; the magnetic units and the bottom ferromagnetic plate are partially wrapped in the protective sleeve, so that the magnetic units maintain the staggered and stacked layout and form two connecting structures at the two ends of the protective sleeve, wherein the staggered layout between two adjacent magnetic units refers to that the gap between two adjacent permanent magnets in one magnetic unit is located at the middle of the permanent magnet in the adjacent magnetic unit, wherein the two connecting structures comprise a connecting cavity and a connecting protrusion that fit in with each other and are formed at the two ends of the protective sleeve respectively; the connecting cavity is formed by the staggered displacement between the two magnetic units and the wall of the protective sleeve; and the connecting protrusion is formed by the protruding part of the permanent magnet out of the protective sleeve.

2. The magnetic track module of claim 1, wherein two adjacent magnetic units are bonded to each other and the bottom ferromagnetic plate and the adjacent magnetic unit are bonded to each other by means of adhesive.

3. The magnetic track module of claim 1, wherein the non-ferromagnetic material comprises at least one of plastic, carbon fiber, aluminum alloy, or stainless steel.

4. The magnetic track module of claim 1, wherein the bottom ferromagnetic plate is made of a soft-magnetic material with a high magnetic permeability.

5. A composite permanent-magnetic track, comprising a plurality of magnetic track modules of claim 1, wherein the magnetic track modules are connected to each other via the connecting structures.

6. A method for installing a composite permanent-magnetic, comprising: assembling a plurality of magnetic track modules via the connecting structures, wherein the composite permanent-magnetic track comprises a plurality of magnetic track modules, wherein the magnetic track modules are connected to each other via the connecting structures, wherein each magnetic track module comprises:

at least two layers of magnetic units that are staggered in a first direction and stacked in a second direction with the same magnetization direction, wherein each magnetic unit is formed by a plurality of permanent magnets that share the same magnetization direction and are arranged closely in the first direction, and the magnetization direction is along the second direction;

a bottom ferromagnetic plate that covers a lower surface of the bottom magnetic unit, with an attractive magnetic force between the bottom ferromagnetic plate and the adjacent magnetic unit;

under the attractive magnetic forces between two adjacent magnetic units and between the bottom ferromagnetic plate and the adjacent magnetic unit, static frictional forces are generated between two adjacent magnetic units and between the bottom ferromagnetic plate and the adjacent magnetic unit and are able to balance out all or part of the repulsive magnetic forces between two adjacent permanent magnets in the same magnetic unit; and a protective sleeve made of a non-ferromagnetic material, and the protective sleeve has an accommodating space fitting the magnetic units and the bottom ferromagnetic plate and two openings at the two ends in connection with the accommodating space; the magnetic units and the bottom ferromagnetic plate are partially wrapped in the protective sleeve, so that the magnetic units maintain the staggered and stacked layout and form two connecting structures at the two ends of the protective sleeve, wherein the staggered layout between two adjacent magnetic units refers to that the gap between two adjacent permanent magnets in one magnetic unit is located at the middle of the permanent magnet in the adjacent magnetic unit, wherein the two connecting structures comprise a connecting cavity and a connecting protrusion that fit in with each other and are formed at the two ends of the protective sleeve respectively; the connecting cavity is formed by the staggered displacement between the two magnetic units and the wall of the protective sleeve; and the connecting protrusion is formed by the protruding part of the permanent magnet out of the protective sleeve.

7. The method for installing the composite permanent-magnetic track of claim 6, wherein the connecting protrusion of one magnetic track module is connected to the connecting cavity of another magnetic track module, forming a composite permanent-magnetic track on which the protective sleeves are aligned to each other at the connection.

* * * * *